US005529304A

United States Patent [19]

Wood

[11] Patent Number: 5,529,304

[45] Date of Patent: Jun. 25, 1996

[54] PRACTICE PUTTING RANGE

[76] Inventor: Ronald Wood, 2200 - 24th Avenue, Vernon, Canada, V1T 1K9

[21] Appl. No.: 259,787

[22] Filed: Jun. 14, 1994

[30] Foreign Application Priority Data

Apr. 14, 1994 [CA] Canada ..... 2121290

[51] Int. Cl.[6] ..... A63B 69/36

[52] U.S. Cl. ..... 473/163; 473/184

[58] Field of Search ..... 273/176, 39 R, 273/179 R, 179 E, 178 B, 181 R, 182 R, 182 A, 181 A, 35 R

[56] References Cited

U.S. PATENT DOCUMENTS

| | | | |
|---|---|---|---|
| 1,558,767 | 10/1925 | Smith | 273/179 R |
| 2,243,720 | 5/1941 | Preece | 273/179 C |
| 3,424,463 | 1/1969 | Matthews | 273/176 |
| 3,603,594 | 9/1971 | Kelley | 273/176 F |
| 3,715,123 | 2/1973 | Baum | 273/35 R |
| 4,160,550 | 7/1979 | Barrett | 273/176 F |
| 5,102,141 | 4/1992 | Jordan | 273/179 R |
| 5,129,653 | 7/1992 | Morris et al. | 273/179 C |
| 5,201,521 | 4/1993 | Healy | 273/179 R |

FOREIGN PATENT DOCUMENTS

| | | | |
|---|---|---|---|
| 311017 | 5/1929 | United Kingdom | 273/179 |
| 1073847 | 6/1967 | United Kingdom | 273/179 R |

*Primary Examiner*—Mark S. Graham
*Attorney, Agent, or Firm*—Baker, Maxham, Jester & Meador

[57] ABSTRACT

A practice putting range has a runway and an adjacent inclined surface, the runway having a putting runway surface, the putting runway surface in flush abutment with an entrance end to the inclined surface, the entrance end of the inclined surface gently curving upwards towards a raised end of the inclined surface opposed to the entrance end, the raised end having therein an aperature through which a golf ball may drop, a golf ball return chute co-operating with the aperature so as to feed the golf ball dropping through the aperature from beneath the inclined surface onto the runway surface, the chute having a golf ball exit aperture engaging the runway surface and aligned relative to the runway surface so as to direct the golf ball exiting the golf ball exit aperture onto the runway surface to a point on a longitudinal medial line along the runway surface.

3 Claims, 4 Drawing Sheets

PRACTICE PUTTING RANGE

FIELD OF THE INVENTION

This invention relates to the field of golf practice devices and in particular to devices for practicing putting.

BACKGROUND OF THE INVENTION

Applicant is aware of British Patent No. 311,017 which issued May 9, 1929 to Eggleston for a device entitled "Improvements in and relating to Game Apparatus". Eggleston teaches a putting device including an inclined putting surface supported by legs and a gravity assisted ball return tube from an aperture in the upper end of the inclined putting surface. The inclined putting surface is a board or sheet having at its' lower end a bevelled under-surface for flush resting engagement with the floor surface. Raised walls are provided around the upper end of the inclined putting surface to prevent a golf ball running off the surface when in play. The legs may be adjusted in their angle relative to the inclined putting surface so as to adjust the inclination of the inclined putting surface.

It has been found that a true putt simulation is not achieved when using the Eggleston device to simulate long putts. Long putts are simulated by increasing the inclination of the inclined putting surface. In particular, the force with which a golf ball must be hit combined with the abrupt inclination of the inclined putting surface as the golf ball enters onto the inclined surface causes the golf ball to jump, often throwing it off the line of the putt.

It has also been found that if the inclined putting surface of the Eggleston device is too low, such as when simulating a short putt, that the golf ball has insufficient energy either when returning along the inclined putting surface or through the ball return tube to send the golf ball back to the golfer.

Consequently, it is an object of the present invention to minimize interference with the path of the golf ball as the golf ball enters onto the inclined surface of the putting device and to incline the putting surface at an angle from which the golf ball will consistently be returned to the golfer.

It is a further object of this invention to provide a golf ball return system using a golf ball return chute and deflecting surface which returns the golf ball to approximately the center of the putting green at the position of the golfer.

SUMMARY OF THE INVENTION

The present invention assists a golfer in training his hand-to-eye coordination. It also assists in teaching the golfer how to properly stroke the golf ball when putting and, in particular, assists in teaching the golfer to deliver the head of the putter down the intended line to the target hole.

Thus, in the present invention, a putting runway and inclined surface is provided. The surface of the putting runway smoothly blends into the inclined surface. At the end of the inclined surface opposed to the runway is the target hole. The target hole is an aperture in the inclined surface co-operating with a return golf ball chute. The return golf ball chute feeds golf balls out from underneath the target hole so as to re-enter the runway from along one side of the inclined surface. A golf ball leaving the return chute is deflected or channeled so as to return the golf ball to approximately the center of the runway at the position of the golfer.

A railing is provided around the perimeter of the runway and inclined surface so as to prevent the golf ball leaving the runway or inclined surface. The incline of the inclined surface is sufficient to return a golf ball to the golfer if the putt is missed, that is, the golf ball does not enter the target hole for return by the return chute.

DETAILED DESCRIPTION OF THE PREFERRED EMBODIMENT

Figure 1:
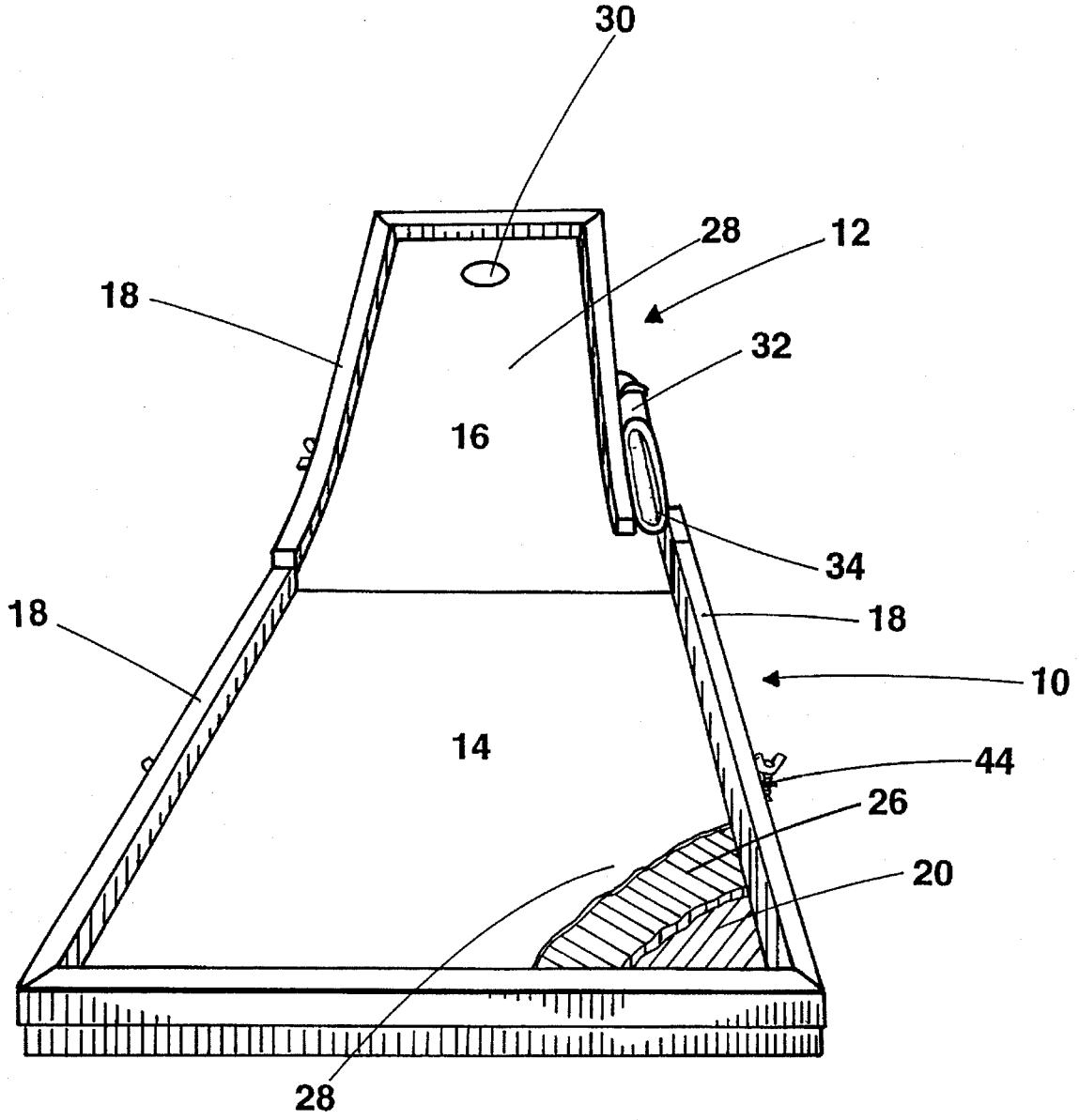
FIG. 1 is a perspective partial cut away view of the practice putting range of the present invention.

As illustrated in FIG. 1, the practice putting range of the present invention has a runway section 10 and a ramp section 12. Runway 10 and ramp 12 may be separate components releasably connected by conventional means such as by dowel pins 13 (see FIG. 2) or the like so long as runway surface 14 is flush with ramp surface 16 when runway 10 abuts ramp 12.

In order to as closely as possible reproduce the feel of an actual putting green, runway 10 may be typically 5 feet long and ramp 12 may be typically 6 feet long. Runway 10 may be approximately 2 feet wide and ramp 12 similarly sized for flush contiguous abutment of runway surface 14 with ramp surface 16 between rails 18. Typically runway surface 14 and ramp surface 16 are covered in a surface material such as conventional indoor-outdoor carpeting.

In one embodiment the putting range of the present invention may be constructed primarily of wood. Rails 18 may be constructed of one and one-quarter inch wood laminate screwed or otherwise affixed to the supporting sub-floor 20 beneath runway surface 14 and ramp surface 16. It has been found that one-half inch plywood is suitable for sub-floor 20. Sub-floor 20 extends the length of runway surface 14 and extends the length of ramp surface 16 continuing in the same plane as under runway surface 14.

Figure 2:
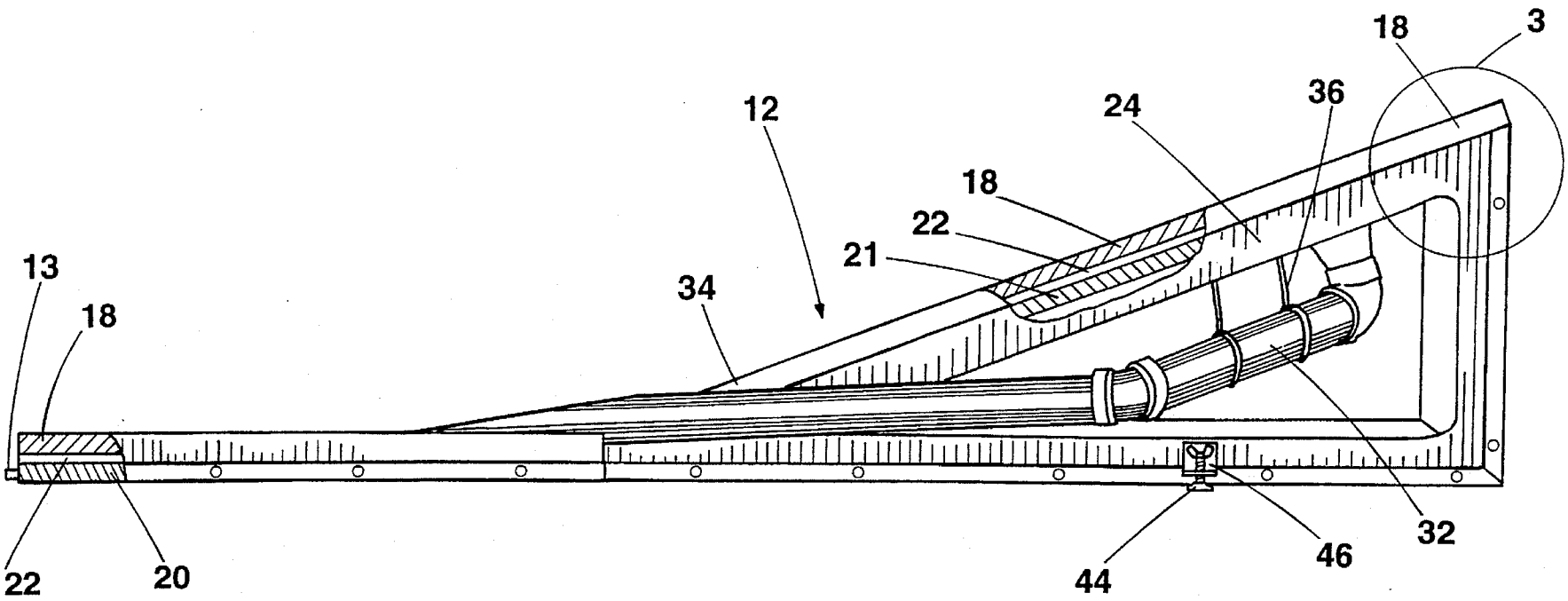
FIG. 2 is a side elevation, partial cut away view of the device of FIG. 1.

As illustrated in FIG. 2, the inclined surface forming the sub-floor to ramp surface 16 is made of material which can be formed into a smoothly upwardly curving inclined ramp. It has been found that one-eighth inch K3™ board is sufficiently flexible to smoothly be formed into a gently curving inclined surface 21 when bolted, screwed or otherwise firmly affixed to an inclined supporting sub-frame 24. Ramp floor 22 abuts runway floor 26 which may also be of equivalent thickness K3™ board so that runway floor 26 is flush with ramp floor 22 when runway 10 abuts ramp 12. Carpeting 28 overlays runway floor 26 and ramp floor 22.

The interior surface of rail 18 around the perimeter of both runway surface 14 and ramp surface 16 may be lined with a resilient bumper padding (not shown). Conventional foam weather-stripping has been found to suffice.

Ramp 12 has at its' upper end target hole 30. Target hole 30 is connected to the upper end of ball return chute 32. It has been found that if hole 30 has a diameter of approximately 4¼ inches, then a plastic funnel or the like may be used as the upper ball receiving end of ball return chute 32, the funnel connected at its' narrower end to conventional two inch plastic or PVC tubing. At its' lowermost end, ball return chute 32 may have a diagonal opening so that for appearance sake the surface of the opening is approximately flush with the upper edge of rail 18.

As illustrated, rail 18 may be configured so that the lower opening 34 of ball return chute 32 delivers a golf ball from ball return chute 32 onto ramp surface 16 approximately flush with ramp surface 16 and runway surface 14. Ball return chute 32 may be suspended from supporting sub-frame 24 by brackets 36 or the like.

Supporting sub-frame 24 may be a structure having sides of plywood cut into approximately the shape of a triangle, the top edge of the triangle being curved to provide for a smooth gently-curving ramp surface 16 when ramp floor 22 is affixed to the top edge of the sides of supporting sub-frame 24. The side of supporting side frame 24 corresponding to the side on which ball return chute 32 exits from underneath ramp surface 16, has a cut out to allow for the exit of ball return chute 32.

Figure 3:
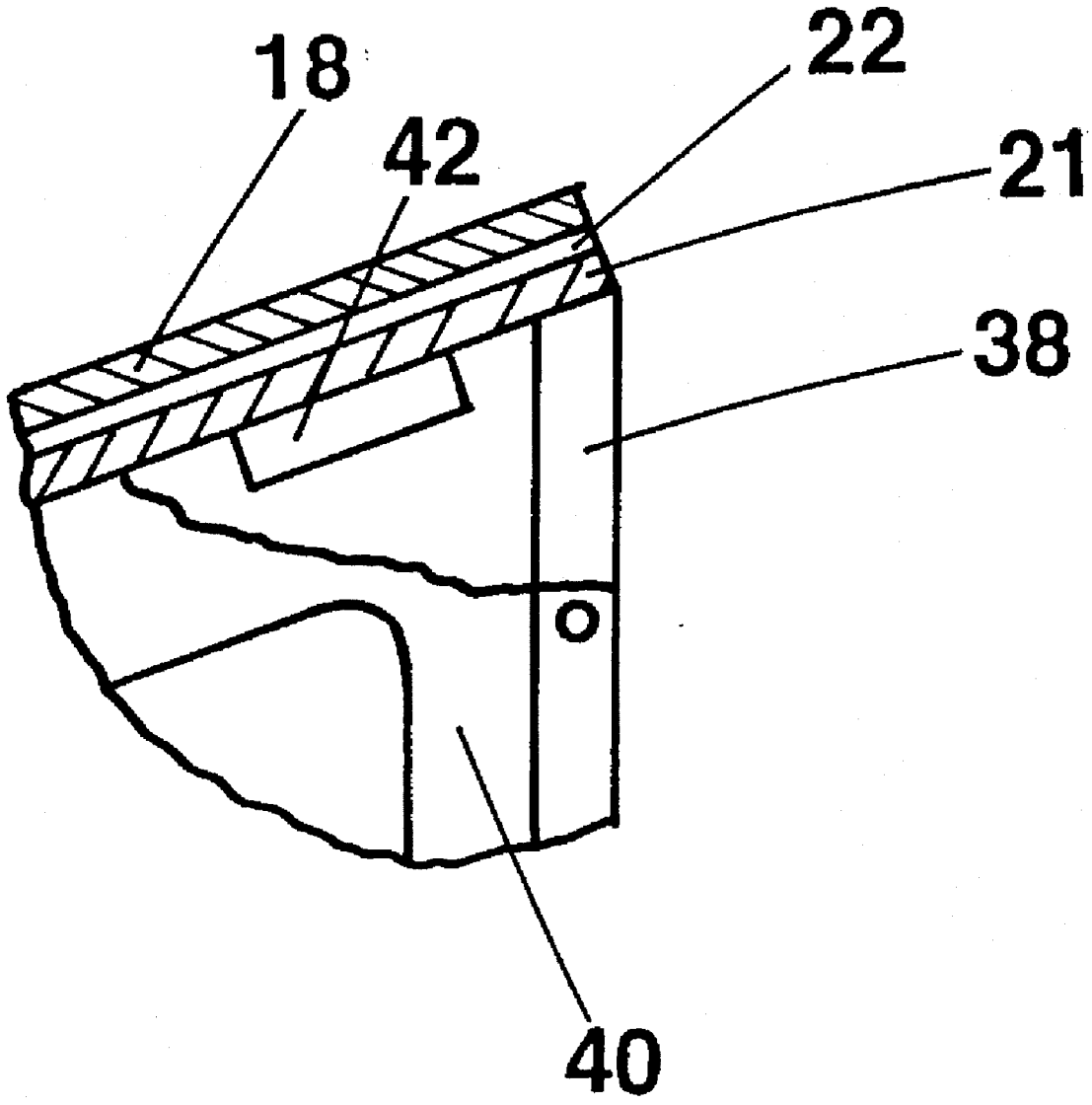
FIG. 3 is an enlarged cut away view of a portion of FIG. 2.

Supporting sub-frame 24 is supported laterally across the bottom by sub-floor 20 and, as illustrated in FIG. 3, between the vertical edges of the triangular sides by vertical back plate 38. Side supports 40 may also be stabilized laterally along their upper curved edge by strapping 42 which may be ½ inch by 3 inch wood strapping. Strapping 42 extends laterally beneath ramp floor 22 and inclined subfloor 21. There may be an array of such laterally supporting the undersurface of ramp floor 22. Supporting sub-frame 24 and in particular side supports 40, should be dimensioned to provide an approximately 30 to 38 degree inclined slope up ramp surface 16.

The smooth curvature of the upper edge of side supports 40 should be sufficiently smooth to provide a gently inclining curved slope to ramp surface 16 so that when a golf ball is hit towards hole 30 from a point on runway surface 14, that even if the ball is hit with considerable force, the ball will not jump as it enters onto the inclined portion of ramp surface 16 and will smoothly track as if putting on a natural putting green.

Screw jacks 44 may be provided, possibly mounted to the sides of runway 10 and ramp 12 by angle brackets 46 so that the otherwise flat surface of runway surface 14 and that portion of ramp surface 16 leading up to the inclined portion thereof, may be gently inclined to simulate long putts.

The outermost portion, i.e. downhill portion of rail 18, where it is split to allow the smooth entry of lower opening 34 of ball return chute 32 onto ramp surface 16, may be cut diagonally so as to provide a deflecting surface 48 for directing the returning golf ball approximately towards the center line of runway surface 14. Thus, a golf ball exiting lower opening 34 would impinge deflecting surface 48 on rail 18. In this manner the golf ball would be returned conveniently close to the head of the putter held by either a left handed or right handed golfer standing near the end of runway surface 14.

Figure 4:
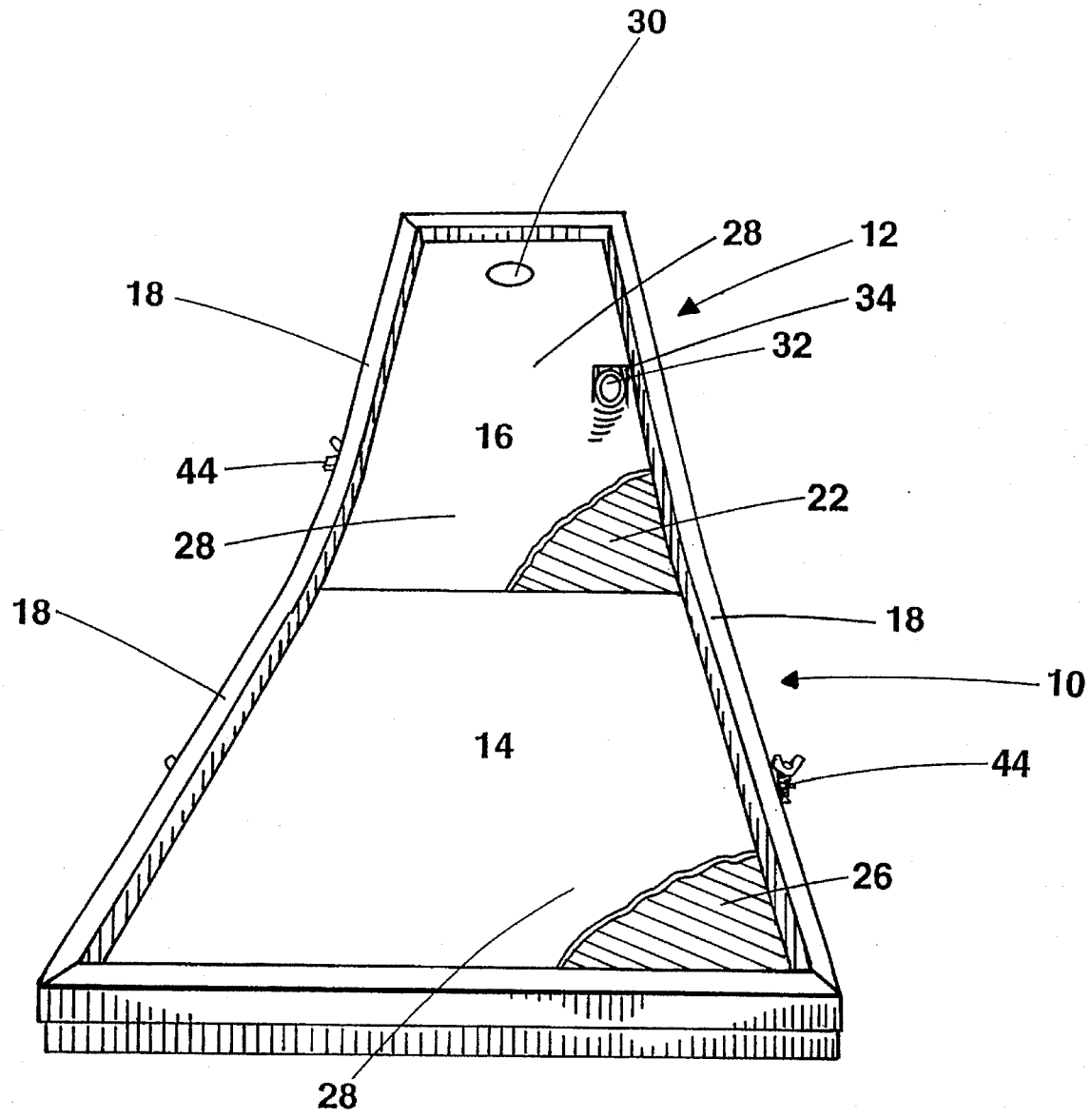
FIG. 4 is a perspective partial cut away view of an alternative embodiment of the practice putting range of the present invention.

A second embodiment of the practice putting range of the present invention, runway 10, ramp 12, rails 18, ramp floor 22 and runway floor 26, and supporting structure therefor, are manufactured from fiberglass. The fiberglass mold substantially reproduces the shape of the practice putting range of the present invention depicted in FIGS. 1–3 with the except, as illustrated in FIG. 4, that ball return chute 32 exits onto ramp surface 16 through lower opening 34 located interior of continuous adjacent rail 18. Further, there is no structural requirement for the equivalent of subfloor 20 and inclined subfloor 21.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A practice putting range comprising:

(a) a runway and an adjacent incline surface, said runway having a putting runway surface, said putting runway surface in flush abutment with an entrance end of said inclined surface, said entrance end of said inclined surface gently curving upwards and curving substantially along the longitudinal length of said inclined surface towards a raised end of said inclined surface opposed to said entrance end, said raised end having therein a first aperture through which a golf ball may drop; and (b) a golf ball return chute co-operating with said first aperture so as to feed said golf ball dropping through said first aperature from beneath said inclined surface onto said runway surface, said shut having a golf ball exit aperture engaging said runway surface and aligned relative to said runway surface so as to direct said golf ball exiting said golf ball exit aperture onto said runway surface to a point on a longitudinal medial line along said runway surface, wherein said golf ball exit aperture is a second aperture in said inclined surface and said means for directing said golf ball exiting said golf ball exit aperture is a gently curved longitudinal channel formed in said inclined surface, said gently curved longitudinal channel gently curving and tapering in a generally longitudinal arc from said golf ball exit aperture towards said longitudinal medial line.

2. The device of claim 1 wherein said practice putting range further comprises resilient bumpers raised above said runway surface and said inclined surface extending around the circumference of said runway and said adjacent inclined surface.

3. A practice putting range comprising:

a runway and an adjacent inclined surface, said runway having a putting runway surface, said putting runway surface in flush abutment with an entrance end of said inclined surface, said entrance end of said inclined surface gently curving upwards and curving substantially along the length of said inclined surface towards a raised end of said inclined surface opposed to said entrance end, said raised end having therein a first aperture through which a golf ball may drop, a golf ball return chute co-operating with said first aperture so as to feed said golf ball dropping through said first aperture from beneath said inclined surface onto said runway surface, said chute having a golf ball exit aperture aligned relative to said runway surface so as to direct said golf ball exiting said golf ball exit aperture onto said runway surface to a point on a longitudinal medial line along said runway surface, means for directing said golf ball exiting said golf ball exit aperature co-operating with said golf ball exit aperture so as to direct said golf ball along said runway surface to approximately a point on said longitudinal medial line along said runway surface at an end of said runway surface opposed to said end abutting said inclined surface, wherein said means for directing said golf ball comprises an angled ball deflector adjacent said golf ball exit aperture, and wherein said golf ball exit aperture is a second aperture in said inclined surface and said means for directing said golf ball exiting said golf ball exit aperture is a gently curved longitudinal channel formed in said inclined surface, said gently curved longitudinal channel gently curving and tapering in a generally longitudinal arc from said golf ball exit aperture towards said longitudinal medial line.

* * * * *